US006039582A

United States Patent [19]

Geis et al.

[11] Patent Number: 6,039,582

[45] Date of Patent: Mar. 21, 2000

[54] DISCHARGE LAMP BALLAST HOUSING WITH SOLDERLESS CONNECTORS

[75] Inventors: David G. Geis, Niles; Peter Doikas, Arlington Heights; Jeffrey Demonaco, West Dundee, all of Ill.

[73] Assignee: Motorola, Inc., Schaumburg, Ill.

[21] Appl. No.: 09/163,818

[22] Filed: Sep. 30, 1998

[51] Int. Cl.[7] ..... H01R 9/09

[52] U.S. Cl. ..... 439/76.1; 439/436; 336/90; 361/736

[58] Field of Search ..... 439/76.1, 226, 439/227, 232, 436, 437, 438; 174/DIG. 2; 361/736, 752, 759; 336/90, 192

[56] References Cited

U.S. PATENT DOCUMENTS

| | | | |
|---|---|---|---|
| 3,956,675 | 5/1976 | Bauer et al. | 317/120 |
| 3,963,316 | 6/1976 | Williams | 439/82 |
| 4,003,617 | 1/1977 | Witek, Jr. et al. | 439/80 |
| 4,216,576 | 8/1980 | Ammon et al. | 29/845 |
| 4,394,692 | 7/1983 | Randmae et al. | 358/229 |
| 4,410,759 | 10/1983 | Kessler | 174/52 |
| 4,576,427 | 3/1986 | Verbruggen | 439/592 |
| 4,600,256 | 7/1986 | Anttila | 439/65 |
| 4,629,271 | 12/1986 | Awano | 439/260 |
| 4,924,152 | 5/1990 | Flickinger | 315/363 |
| 5,101,322 | 3/1992 | Ghaem et al. | 361/386 |
| 5,122,064 | 6/1992 | Zareii | 439/65 |
| 5,145,408 | 9/1992 | Houtteman et al. | 439/581 |
| 5,224,865 | 7/1993 | Woith et al. | 439/67 |
| 5,229,923 | 7/1993 | Long et al. | 361/415 |
| 5,281,150 | 1/1994 | Bundga et al. | 439/67 |
| 5,311,398 | 5/1994 | Schirmer et al. | 361/704 |
| 5,422,783 | 6/1995 | Darbee | 361/600 |
| 5,580,272 | 12/1996 | Yamaguchi et al. | 439/495 |
| 5,691,878 | 11/1997 | Ahn et al. | 361/674 |

*Primary Examiner*—Renee S. Luebke
*Assistant Examiner*—T C Patel
*Attorney, Agent, or Firm*—Kenneth D. Labudda

[57] ABSTRACT

A ballast housing (10) comprising a base (100), a cover (200), an input connector (300), and an output connector (400). Input connector (300) and output connector (400) serve as end-caps of the housing (10), and provide solderless connections between external wires and the ballast circuitry. The base (100) has formed edges (132,142) that are received into corresponding channels (242,252) in the cover (200). Tabs on the connectors (300,400) and corresponding apertures in the base (100) and cover (200) provide a secure ballast housing that accommodates efficient provision of input and output wires.

23 Claims, 6 Drawing Sheets

DISCHARGE LAMP BALLAST HOUSING WITH SOLDERLESS CONNECTORS

FIELD OF THE INVENTION

The present invention relates to the general subject of housings and assemblies for electronic devices. More particularly, the present invention relates to a discharge lamp ballast housing with solderless connectors.

BACKGROUND OF THE INVENTION

Many types of ballasts for powering gas discharge lamps have metallic housings in which the cover is riveted to the base. Such housings provide durable mechanical protection of ballast electrical components, but have several disadvantages. For instance, metallic housings are relatively heavy, require riveting machinery for attaching the cover to the base, and are generally not reusable if opened for inspection or repair of the ballast circuitry.

Some other types of ballasts have a housing that may be non-destructively disassembled to allow repair, etc. An example of such a housing is described in U.S. Pat. No. 5,691,878. Such housings are typically composed of plastic, are lighter in weight than metallic housings, and may be manually assembled and disassembled. However, such housings may not provide an adequate degree of heat-sinking to maintain an appropriate operating temperature for the ballast electrical components, which is critical to providing a reliable ballast with an acceptable operating life.

A shortcoming that is common to existing ballasts pertains to the problem of providing input and output wires. It is well known in the ballast industry that many customers require that the ballast manufacturer provide ballasts with pre-installed input and output wires. To meet this requirement, existing ballasts employ either: (i) a hard-wired scheme in which the wires are actually soldered to the circuit board; or (ii) wire-trap connectors that are soldered to the circuit board. In the former case, the wires are usually manually soldered to the circuit board in a separate process after the circuit board has been populated with components and initially soldered. The requirement of a separate soldering process renders such ballasts ill-suited for production in an automated manufacturing environment. Ballasts that employ input and output connectors that are soldered to the circuit board along with the other electrical components avoid the need for a separate soldering operation. However, since the wires cannot be managed during the soldering operation, they must be inserted manually on a post-production basis (i.e., after the ballast is completely assembled). This approach has obvious logistical and efficiency problems. For example, product shipping is inevitably delayed while the wires are being inserted into the input and output connectors.

What is needed therefore is a housing that provides secure and reliable mechanical protection of electronic ballast circuitry, that is readily assembled and nondestructively disassembled, that provides adequate heatsinking for electrical components, and that accommodates efficient installation of wires in an automated manufacturing environment. Such a ballast housing would represent a significant advance over the prior art.

DETAILED DESCRIPTION OF THE PREFERRED EMBODIMENTS

Figure 1:
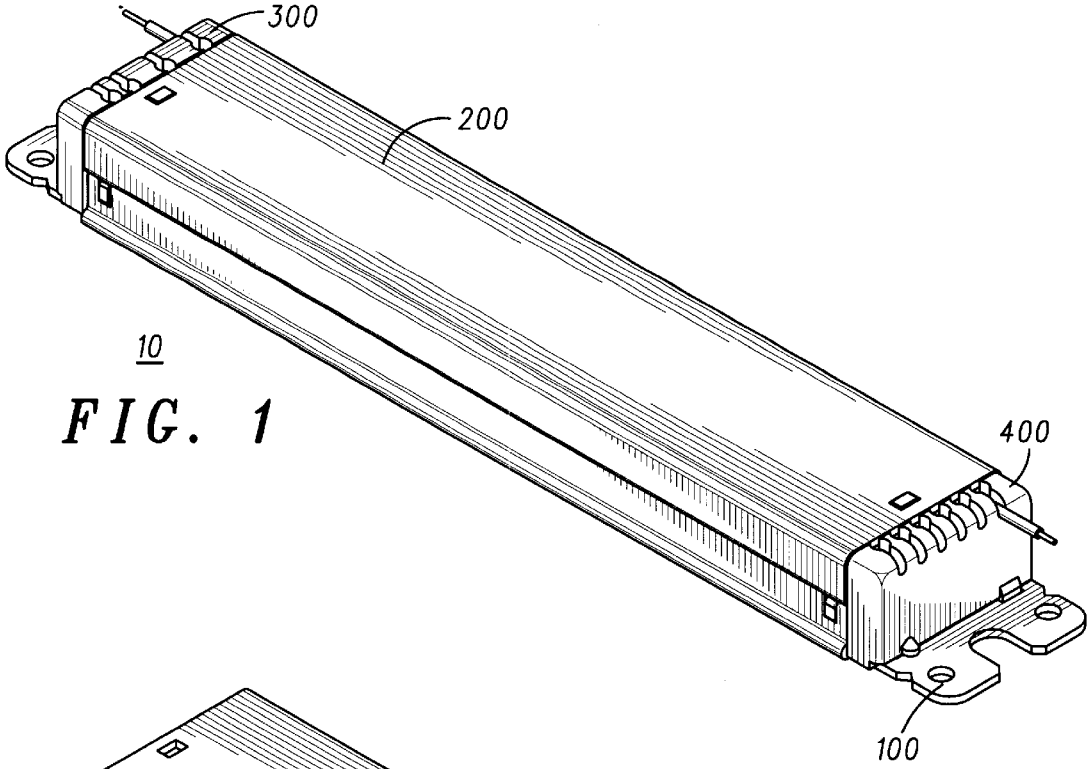
FIG. 1 describes an assembled electronic ballast housing, in accordance with a preferred embodiment of the present invention.

An assembled ballast housing 10 is described in FIG. 1. Housing 10 comprises a base 100, a cover 200, an input connector 300, and an output connector 400. Input connector 300 and output connector 400 are adapted to serve as endcaps for the housing. Ballast housing 10 provides a number of benefits, such as excellent heat-sinking capability and ease of assembly/disassembly. Additionally, by employing solderless input and output connectors that also serve as end-caps, housing 10 accommodates provision of wires in a logistically efficient manner; more particularly, since the connectors are not soldered to the circuit board, wires may be inserted in the connectors at any point prior to final assembly of the housing. The end result is a reduction in the time and effort required to produce a ballast in which input and output wires are provided.

Figure 2:
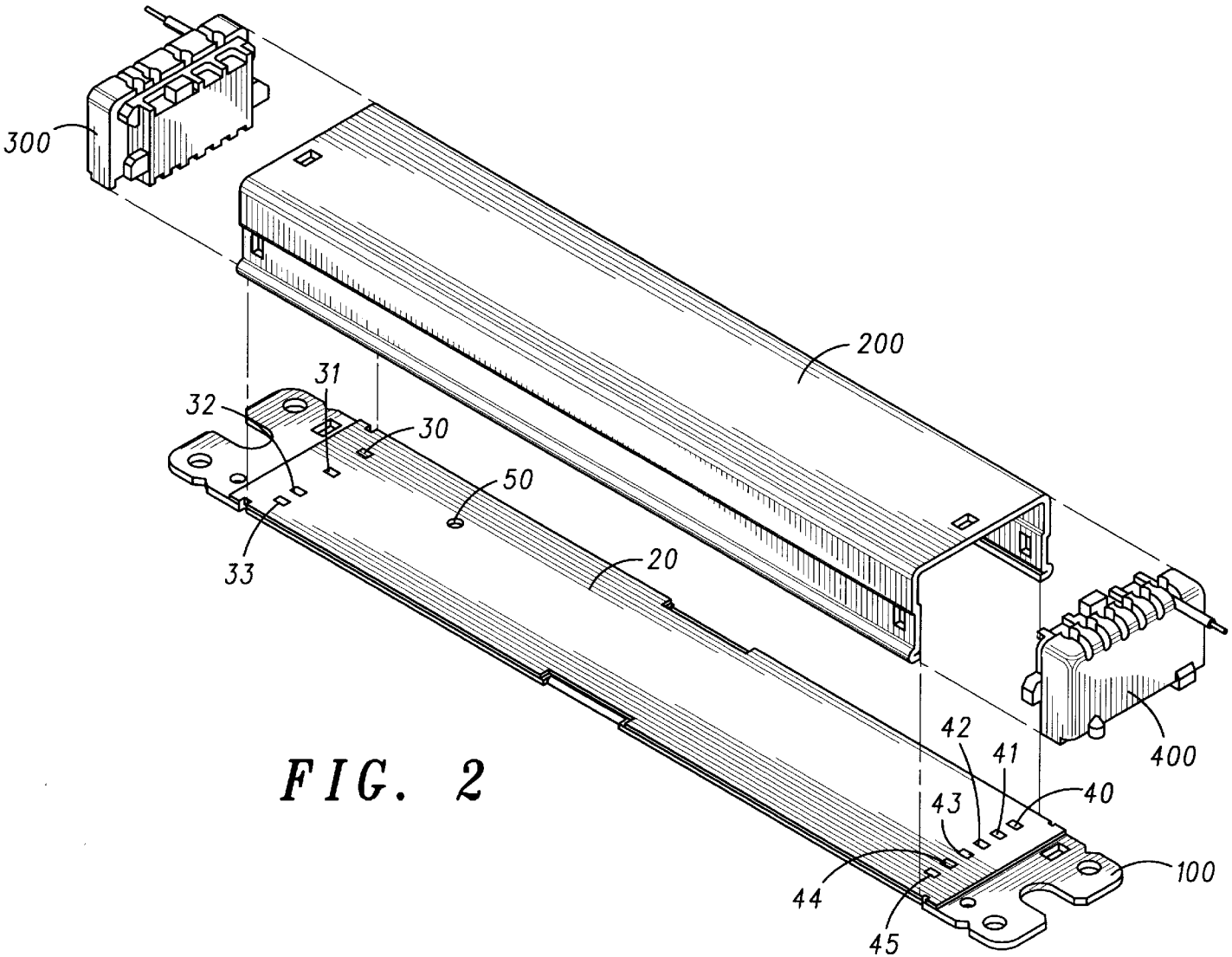
FIG. 2 is an exploded view of a ballast housing and circuit board, in accordance with a preferred embodiment of the present invention.

FIG. 2 is an exploded view of housing 10 that shows a circuit board 20 attached to base 100. Although not explicitly shown in the drawings, it should be understood that circuit board 20 is intended to be populated with surface-mount (SMD) components operable to power one or more gas discharge lamps. For purposes of providing superior heat transfer from the components to the base of the housing, circuit board 20 is preferably implemented as a thin printed circuit board, such as a flex circuit, composed essentially of a dielectric insulating material, such as polyamid or polyethylene napthilate (PEN), with copper traces disposed thereon. Circuit board 20 is attached to base 100 using a suitable pressure-sensitive adhesive (PSA), such as 3M9460 manufactured by Minnesota Mining and Manufacturing (3M). Circuit board 20 includes a plurality of copper pads 30, . . . ,33,40, . . . ,45 for providing electrical connections with input connector 300 and output connector 400, as well as a ground plug 50 that provides an electrical ground connection between base 100 and one or more ground traces on board 20.

Figure 3:
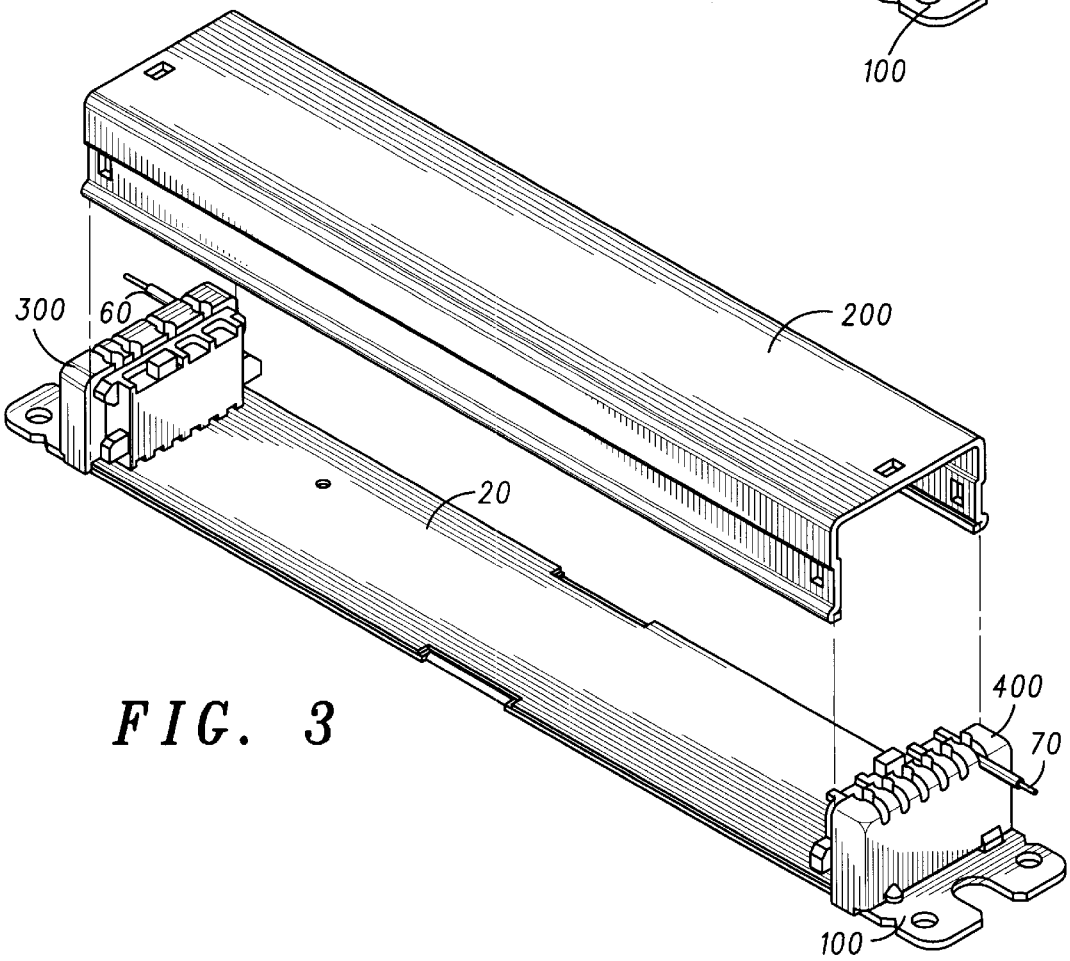
FIG. 3 describes a partially assembled ballast housing and circuit board, in accordance with a preferred embodiment of the present invention.

FIG. 3 is a partially assembled view of housing 10 in which input connector 300 and output connector 400 are attached to base 100 and circuit board 20. Wires 60,70 are included for explanation purposes to illustrate the intended application of input connector 300 and output connector 400.

Figure 4:
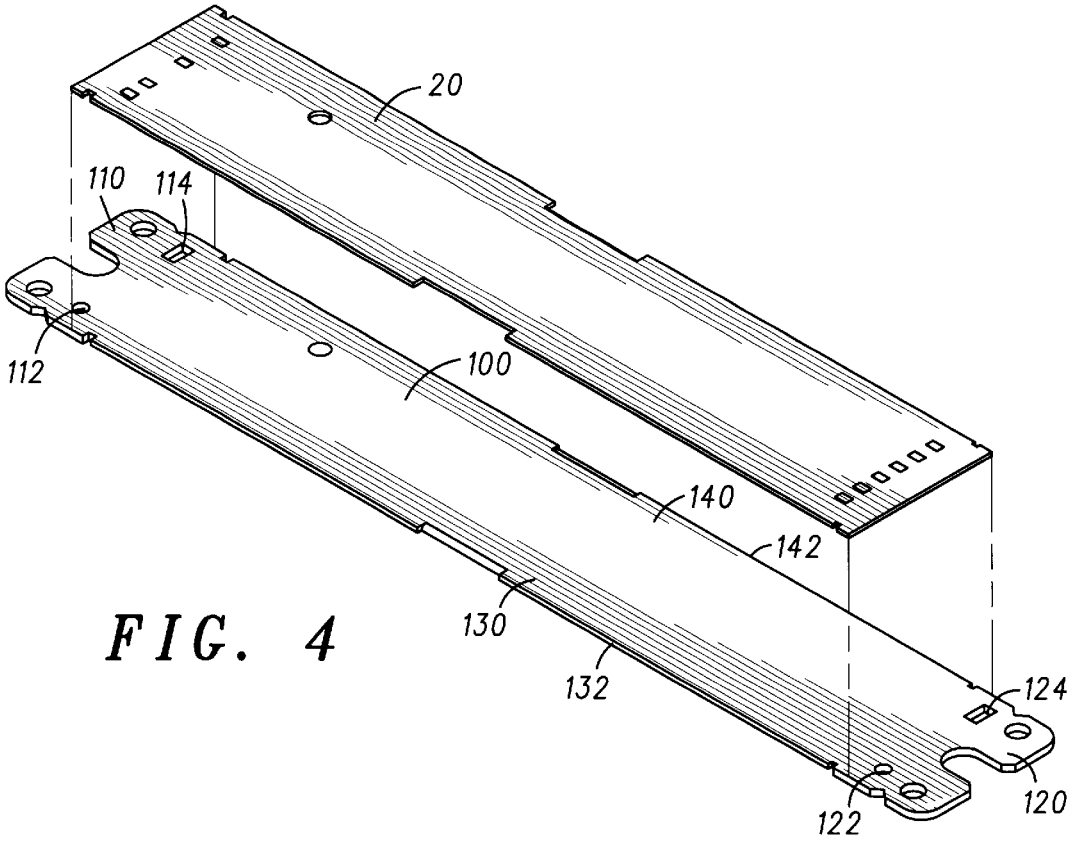
FIG. 4 describes a base of the ballast housing, in accordance with a preferred embodiment of present invention.

Turning now to FIG. 4, base 100 has an input end 110, and output end 120, a left end 130, and a right end 140. Output end 120 is opposite to input end 110. Left end 130 is adjacent to input end 110 and output end 120. Right end 140 is adjacent to input end 110 and output end 120, and is opposite to left end 130. Base 100 is preferably composed of a metal, such as aluminum, that provides, among other benefits, a high degree of heat transfer from the ballast to a lighting fixture or other surface to which the ballast is mounted during use. The heat-sinking benefit is particularly significant when circuit board 20 is implemented as a thin flex circuit that provides exceptional heat transfer from the ballast circuit components to the metallic base. As is well known to those skilled in the art of ballasts, an effective heat-sinking approach dramatically enhances the reliability and operating life of the ballast circuitry.

In general, the input and output ends 110,120 of base 100 each include at least one aperture. As described in FIG. 4, input end 110 preferably includes a first aperture 112 and a second aperture 114, where first aperture 112 has a shape that is substantially different from that of second aperture 114. For example, first aperture 112 is circular, while second aperture 114 is rectangular. Similarly, output end 120 preferably includes a first aperture 122 and a second aperture 124, where first aperture 122 has a shape that is substantially different from that of second aperture 124. For example, first aperture 122 is circular, while second aperture 124 is rectangular. As will be discussed in greater detail below, the apertures 112,114,122,124 in base 100 receive corresponding tabs in the input and output connectors when the ballast housing is assembled. The use of different shapes for the apertures provides a "keying" feature that facilitates correct assembly of the ballast housing.

Figure 5:
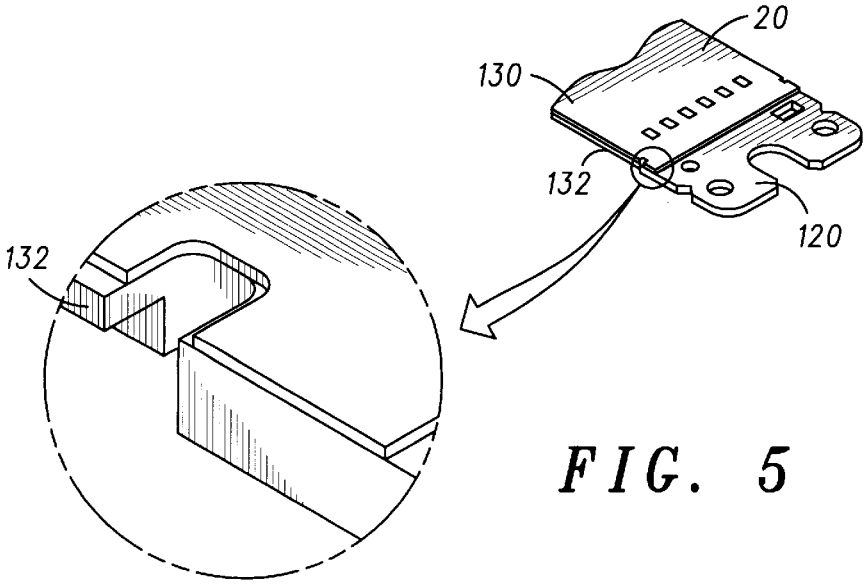
FIG. 5 is a detailed view of an edge of the base, in accordance with a preferred embodiment of the present invention.
Figure 6A:
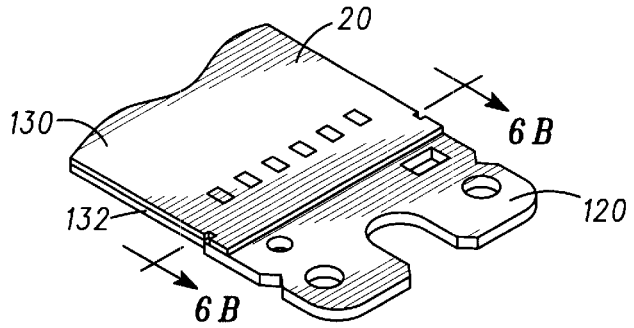
FIG. 6 is a cross-sectional view of an edge of the base, in accordance with a preferred embodiment of the present invention.
Figure 6B:
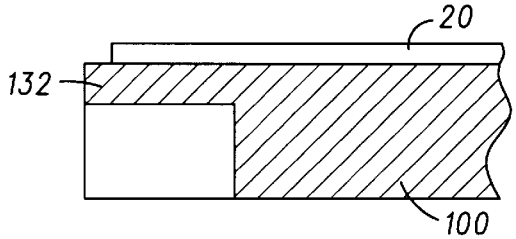

The left and right ends 130,140 of base 100 include edges 132,142 having a thickness less than that of the rest of base 100. Preferably, the left and right edges 132,142 each have a substantially "L" shaped cross-section. FIGS. 5 and 6 illustrate this feature in detail with regard to left edge 132. Since base 100 is preferably composed of a metal, such as aluminum, an approximately "L" shaped cross-section can be provided by coining of the left and right edges 132,142 in accordance with known metal-working processes.

Figure 7:
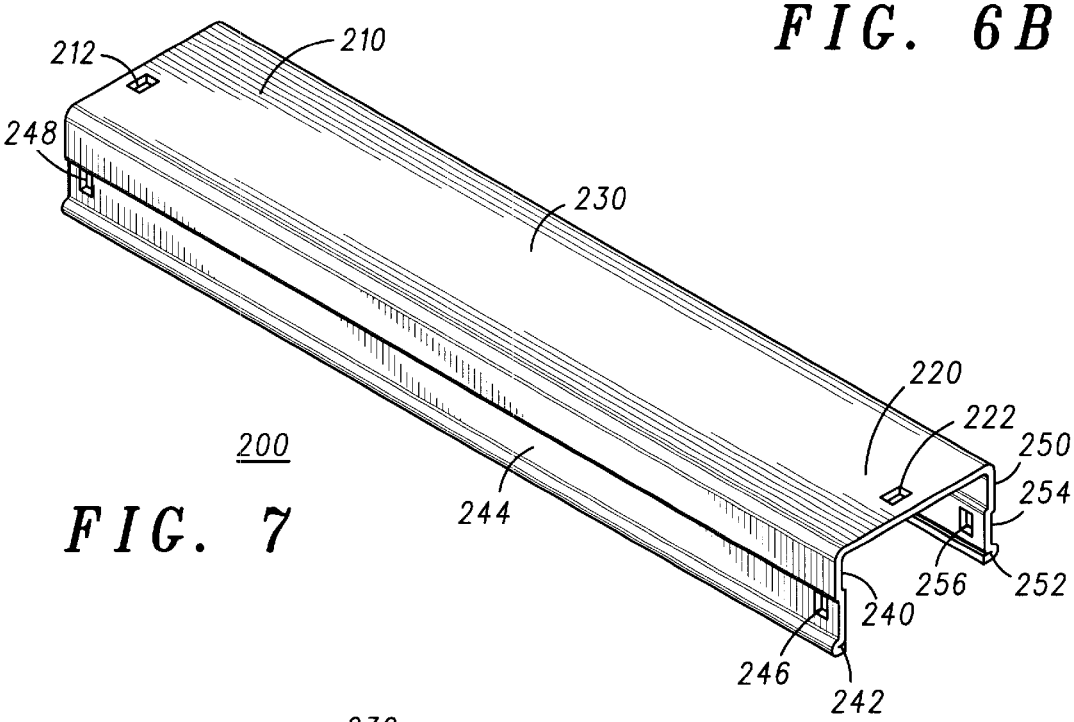
FIG. 7 describes a cover of the housing, in accordance with a preferred embodiment of the present invention.
Figure 8:
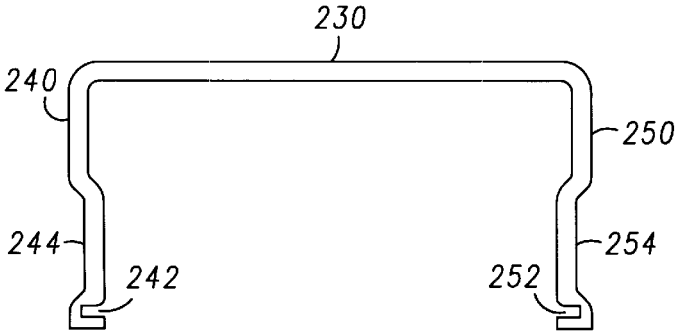
FIG. 8 is a front view of the cover of FIG. 7, in accordance with a preferred embodiment of the present invention.

Turning now to FIGS. 7 and 8, cover 200 has an input end 210, an output end 220, a top side 230, a left side 240, and a right side 250. Left side 240 is at approximately right angles with top side 230. Right side 250 is also at approximately right angles with top side 230 and is remote from left side 240. The left and right sides 240,250 of cover 200 each include a channel 242,252 for mating with the left and right edges of the base of the housing. Preferably, the left and right sides 240,250 of cover 200 also include indented portions 244,254 adjacent to channels 242,252.

Referring now to FIG. 7, the input and output ends 210,220 of cover 200 each include at least one aperture defined therein. Preferably, the output end 220 of cover 200 includes a left aperture 246 in the indented portion 244 on left side 240, a right aperture 256 in the indented portion 254 on right side 250, and a top aperture 222 in top side 230. Similarly, the input end 210 of cover 200 includes a left aperture 248 in the indented portion 244 on left side 240, a right aperture (not explicitly shown in the drawings, but recited herein) in the indented portion 254 on right side 250, and a top aperture 212 in top side 230. The apertures in cover 200, like those in the base, are adapted to receive corresponding tabs in the input and output connectors, and thus provide support that enhances the structural integrity and strength of the housing. Advantageously, having apertures positioned in the indented portions 244,254 on the sides 240,250 of cover 200 ensures that the corresponding tabs on the input and output connectors do not protrude beyond the sides 240,250 of the cover 200.

For simplicity, the shapes of the apertures are shown in as rectangular in FIG. 7, but are not necessarily so limited in practice. Preferably, the apertures 212,222 in the top side 230 of cover 200 are offset in relation to each other (e.g., aperture 212 is positioned closer to left side 240 than to right side 250, while aperture 222 is approximately centered between left side 240 and right side 250) to provide a "keying" feature that guarantees that cover 200 is attached with the appropriate orientation relative to the input and output connectors. Accordingly, the input connector will a tab that is correspondingly positioned to mate with aperture 212 when the housing is assembled. This keying feature is desirable since, in view of the fact that a label with wiring information is typically placed on the top side 230 of cover 200, it is necessary that certain label information (e.g., wiring diagrams) lie proximate to the input side 210 of cover 200, while other label information lie proximate to the output side 220 of cover 200.

Cover 200 may be composed of any of a number of materials with suitable mechanical properties. For example, the sides 230,240,250 of cover 200 must be at least partially flexible so as to facilitate attachment of cover 200 to the base. A preferred material in this regard is polyphenylene oxide (PPO), which is sold under the trade name "noryl" and manufactured by General Electric (GE) Plastics in Pittsfield, Mass.

Figure 9:
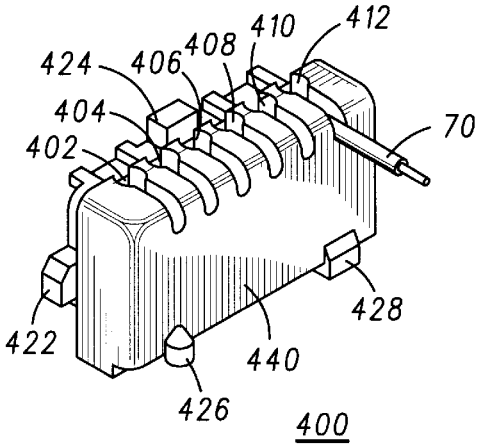
FIG. 9 is a front-elevational view of an output connector, in accordance with a preferred embodiment of the present invention.
Figure 10:
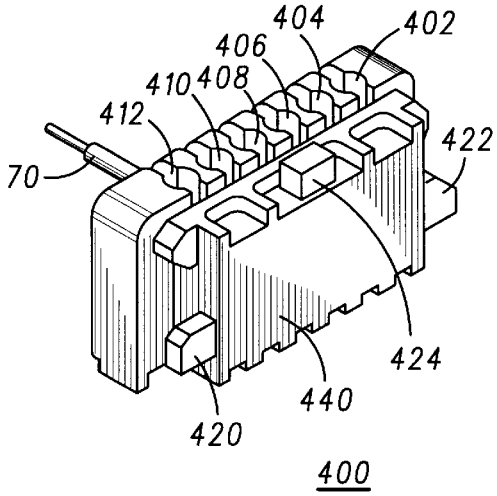
FIG. 10 is a rear-elevational view of the output connector of FIG. 9, in accordance with a preferred embodiment of the present invention.

Turning now to FIGS. 9 and 10, output connector 400 includes a plurality of receptacles 402, . . . , 412 for receiving output wires, and a plurality of tabs 420,422,424,426,428 for mating with the apertures in the output ends of the base and cover. The number of receptacles required in output connector 400 is dictated by the type of ballast and the number of lamps powered by the ballast. For example, for a rapid-start type ballast that powers two fluorescent lamps, output connector 400 will require six receptacles in the output connector since six output wires are required for such a ballast. On the other hand, for an instant-start type ballast that powers a single fluorescent lamp, output connector need only have two receptacles since only two output wires are required for such a ballast. Although the following discussion explicitly refers to output connector 400, it should be understood that much of the following discussion applies, by implication, to input connector 300 as well, since input connector 300 has many of the same structural and functional attributes as output connector 400.

In a preferred embodiment, as described in FIGS. 9 and 10, output connector 400 preferably includes a right tab 420 (see FIG. 10), a left tab 422, a top tab 424, a first bottom tab 426, and a second bottom tab 428. When the housing is assembled, tabs 420,422,424 are inserted in their corresponding apertures in the cover, and bottom tabs 426,428 are inserted in their corresponding apertures in the base. Preferably, first bottom tab 426 and second bottom tab 428 are substantially different in shape. For example, first bottom tab 426 is circular, while second bottom tab 428 is rectangular, with the corresponding apertures in the base configured accordingly. A similar scheme is employed with regard to input connector 300. By having a different shape for the two bottom tabs on each connector, as well as corresponding apertures in the base, the housing is "keyed" to prevent incorrect placement of the input and output connectors. That is, the assembler is prevented from mistakenly placing the input connector where the output connector belongs, and vice-versa.

Figure 11:
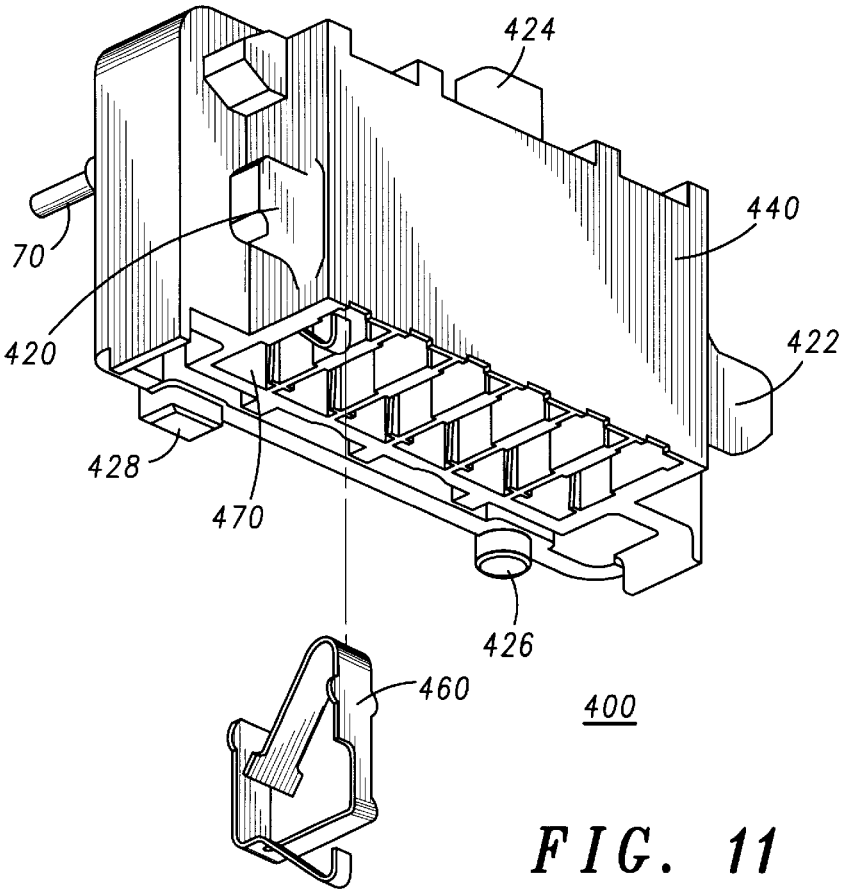
FIG. 11 describes the output connector of FIGS. 9 and 10 with a wire-trap spring contact assembly, in accordance with a preferred embodiment of the present invention.

As described in FIG. 11, output connector 400 preferably comprises an insulating structure 440 and a plurality of metallic wire-trap spring contact assemblies; for clarity, only one wire-trap spring contact assembly 460 is depicted, although it should be understood that each receptacle requires its own contact assembly. Each wiretrap spring contact assembly 460 is seated within a corresponding cavity 470 in insulating structure 440.

Figure 12:
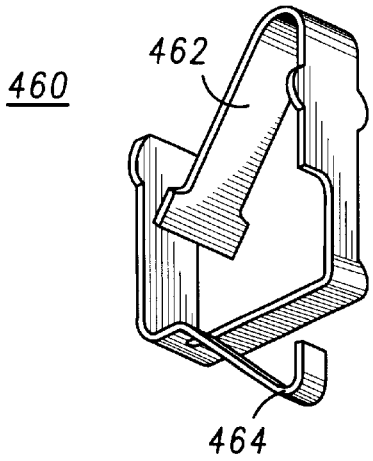
FIG. 12 is a detailed view of a wire-trap spring contact assembly, in accordance with a preferred embodiment of the present invention.
Figure 13:
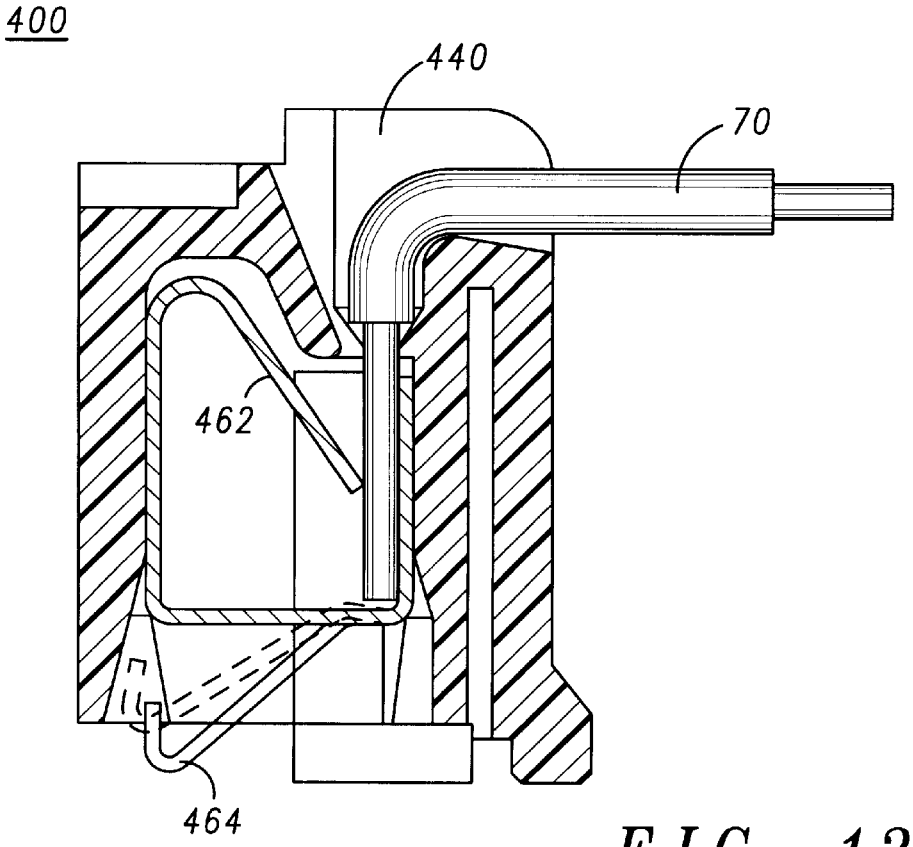
FIG. 13 is a cross-sectional view of the output connector of FIGS. 9–11, in accordance with a preferred embodiment of the present invention.

Referring now to FIGS. 12 and 13, each wire-trap spring contact assembly 460 is operable to receive, retain, and make physical contact with a stripped end of a wire 70 when the wire 70 is inserted into a corresponding receptacle in the insulating structure 440 of output connector 400. Each metallic wire-trap spring contact assembly 460 includes a wire-trap portion 462 and a solderless connector portion 464. Wire-trap portion 462 deflects upon insertion of a stripped end of wire 70 into a corresponding receptacle in the insulating structure of the connector, and thus defines a channel for receiving and securely retaining the stripped end of wire 70. During attachment of the connector to the base of the housing, solderless connector portion 464 deflects under contact with a corresponding pad on the circuit board, and thereby provides a secure electrical connection with the pad on the circuit board. In this way, output connector provides a solderless connection between the output wires and the ballast circuitry. Consequently, wires may be pre-inserted into the output connector prior to final assembly of the ballast housing, thus greatly streamlining the process of providing wires with the ballast.

Referring back to FIG. 2, it should be understood that input connector 300 includes many of the same features previously described with regard to output connector 400. Like output connector 400, input connector 300 includes wire-trap spring contact assemblies for providing solderless connection between the output wires and the ballast circuitry, as well as a plurality of tabs for insertion into corresponding apertures in the output sides of the base and cover. More specifically, input connector 300 includes a plurality of receptacles for receiving input wires, and a plurality of tabs for mating with corresponding apertures in the input ends of the base and cover. In some ballast applications, input connector 300 requires only two receptacles for receiving the hot and neutral wires of the AC power source; however, in other applications, input connector may include additional receptacles for receiving additional wires, such as those from a dimming controller or additional output wires that, due to size and spacing constraints, cannot be accommodated by output connector 400.

The insulating structure of the input and output connectors is composed of a suitable insulating material with appropriate electrical and mechanical properties. For instance, the material must have sufficient dielectric strength in order to resist arcing between adjacent receptacles when a line transient or other electrical disturbance occurs in the AC power system. The material must also be sufficiently durable such that the tabs, which are preferably molded as an integral part of the insulating structure, do not break off under expected stresses (e.g., if the ballast is mistakenly dropped from a modest height). A suitable material in this regard in polyphenylene oxide (PPO), which was previously mentioned as a preferred material for the cover.

The metallic wire-trap spring contact assemblies may be fabricated from any of a number of suitable metals, such as phosphor bronze, brass, or beryllium copper. If the wire trap spring-contact assemblies are fabricated with brass, it is advisable that "spring" brass (i.e., a specific type of "cartridge" brass having a relatively high tensile strength) be used. In order to ensure a secure electrical connection with the pads on the circuit board, it is highly preferred that each metallic wire-trap spring contact assembly be capable of providing a contact force of between about 100 grams and about 200 grams to a corresponding pad on the circuit board. Roughly speaking, it is believed that a contact force that is considerably less than 100 grams may not ensure a reliable, low resistance electrical connection, while a contact force that is substantially greater than 200 grams may result in physical damage to the copper pads on the circuit board during assembly of the housing.

As previously described, during assembly of the housing, base 100 and cover 200 are attached to each other by way of the channels on cover 200 and the coined edges on base 100. As an alternative approach, the edges of circuit board 20 may be used to provide the same securing function as the coined edges of the base, thus eliminating the requirement that base 100 have specially formed edges; in this alternative approach, circuit board 20 is made slightly wider than base 100 so that its overlapping edges are received into the channels in cover 200.

The disclosed ballast housing 10 provides a number of features that, in combination, represent a significant improvement over existing ballast housings. First, housing 10 accommodates provision of input and output wires in a logistically efficient and cost-effective manner. Housing 10 provides secure and reliable mechanical protection of electronic ballast circuitry, yet is readily assembled and non-destructively disassembled. Further, when used in conjunction with a thin film circuit board, housing 10 provides an exceptional degree of heat-sinking for electrical components. The end result is a ballast that is reliable, safe, and well-suited for efficient production in an automated manufacturing environment.

Although the present invention has been described with reference to certain preferred embodiments, numerous modifications and variations can be made by those skilled in the art without departing from the novel spirit and scope of this invention.

What is claimed is:

1. A housing for a gas discharge lamp ballast, comprising:

a base for mounting a circuit board thereon, the base including an input end, an output end opposite the input end, a left end adjacent to the input and output ends, and a right end opposite the left end and adjacent to the input and output ends, wherein:

(i) the left and right ends include edges having a thickness substantially less than that of the rest of the base; and (ii) the input and output ends of the base each include at least one aperture defined therein;

a cover having a top side, a left side at approximately right angles with the top side, and a right side at approximately right angles with the top side and remote from the left side, wherein the cover has an input end and an output end each having at least one aperture therein, the left and right sides each including a channel therein for mating with the edges on the left and right ends of the base;

an input connector adapted to serve as a first end-cap of the housing, the input connector including a plurality of receptacles for receiving input wires and a plurality of tabs for mating with the corresponding apertures in the input ends of the base and cover; and an output connector adapted to serve as a second end-cap of the housing, the output connector including a plurality of receptacles for receiving output wires and a plurality of tabs for mating with the corresponding apertures in the output ends of the base and cover.

2. The housing of claim 1, wherein the input and output connectors each comprise:

an insulating structure including a plurality of cavities defined therein, each cavity being adjacent to a corresponding receptacle; and a plurality of metallic wire-trap spring contact assemblies, each seated within a corresponding cavity in the insulating structure and operable to receive, retain, and make physical contact with a stripped end of a wire, and to make physical contact with a corresponding metallic pad on the circuit board.

3. The housing of claim 2, wherein each metallic wire-trap spring contact assembly includes:

a wire-trap portion operable to deflect upon insertion of a stripped end of a wire into a corresponding receptacle in the insulating structure of the connector, thereby defining a channel for receiving and substantially securely retaining the stripped end of the wire; and a solderless connector portion coupled to the wire-trap portion and operable, upon attachment of the connector to the base, to deflect under contact with a corresponding pad on the circuit board and thereby provide a substantially secure electrical contact with the corresponding pad on the circuit board.

4. The housing of claim 2, wherein the insulating structure of the input and output connectors is composed essentially of polyphenylene oxide.

5. The housing of claim 2, wherein each of the metallic wire-trap spring contact assemblies is composed essentially of one of: phosphor bronze, brass, and beryllium copper.

6. The housing of claim 2, wherein each metallic wire-trap spring contact assembly provides a contact force of between about 100 grams and about 200 grams to a corresponding pad on the circuit board.

7. The housing of claim 1, wherein the left, right, and top sides of the cover are at least partially flexible so as to facilitate attachment of the cover to the left and right ends of the base.

8. The housing of claim 1, wherein the cover is composed essentially of polyphenylene oxide.

9. The housing of claim 1, wherein the edges of the left and right ends of the base have a substantially "L" shaped cross-section.

10. The housing of claim 1, wherein the edges of the left and right ends of the base are coined.

11. The housing of claim 1, wherein the base is composed essentially of aluminum.

12. The housing of claim 1, wherein:

the input and output ends of the base each include a first aperture and a second aperture, wherein the first aperture has a shape that is substantially different from that of the second aperture; and the input and output connectors each include a first bottom tab and a second bottom tab, wherein the first and second bottom tabs are substantially different in shape and are configured for insertion in the first and second apertures in the base.

13. The housing of claim 12, wherein:

the first bottom tab and the first aperture in the base are substantially circular in shape; and the second bottom tab and the second aperture in the base are substantially rectangular in shape.

14. The housing of claim 1, wherein the left and right sides of the cover include indented portions adjacent to the channels.

15. The housing of claim 14, wherein:

the input and output ends of the cover each include a left aperture in the indented portion of the left side of the cover, a right aperture in the indented portion of the right side of the cover, and a top aperture in the top side of the cover; and the input and output connectors each include left, right, and top tabs adapted for insertion in the left, right, and top apertures in the cover.

16. The housing of claim 15, wherein:

the left, right, and top apertures in the cover are substantially rectangular in shape; and the left, right, and top tabs of the input and output connectors are substantially rectangular in shape.

17. The housing of claim 1, wherein the circuit board is populated with components operable to power at least one gas discharge lamp.

18. A housing for a gas discharge lamp ballast, comprising:

a metallic base for mounting a circuit board thereon, the base including an input end, an output end opposite the input end, a left end adjacent to the input and output ends, and a right end opposite the left end and adjacent to the input and output ends, wherein:

(i) the left and right ends include coined edges having a substantially "L" shaped cross-section; and (ii) the input and output ends of the base each include at least one aperture therein;

a cover having a top side, a left side at approximately right angles with the top side, and a right side at approximately right angles with the top side and remote from the left side, wherein the cover has an input end and an output end each having at least one aperture therein, the left and right sides each including a channel therein for mating with the left and right ends of the base, wherein the left, right, and top sides of the cover are at least partially flexible so as to facilitate attachment of the cover to the coined edges of the left and right ends of the base;

an input connector adapted to serve as a first end-cap of the housing, wherein the input connector includes a plurality of receptacles for receiving input wires and a plurality of tabs for mating with the corresponding apertures in the input ends of the base and cover; and an output connector adapted to serve as a second end-cap of the housing, wherein the output connector includes a plurality of receptacles for receiving output wires and a plurality of tabs for mating with the corresponding apertures in the output ends of the base and cover, wherein the input and output connectors each comprise:

an insulating structure including a plurality of cavities defined therein, each cavity being adjacent to a corresponding receptacle; and a plurality of metallic wire-trap spring contact assemblies, each seated within a corresponding cavity in the insulating structure and operable to receive, retain, and make physical contact with a stripped end of a wire, and to make physical contact with a corresponding metallic pad on the circuit board.

19. The housing of claim 18, wherein each metallic wire-trap spring contact assembly includes:

a wire-trap portion operable to deflect upon insertion of a stripped end of a wire into a corresponding receptacle in the insulating structure of the connector, thereby forming a channel for receiving and substantially securely retaining the stripped end of the wire; and a solderless connector portion coupled to the wire-trap portion and operable, upon attachment of the connector to the base, to deflect under contact with a corresponding pad on the circuit board and thereby provide a substantially secure electrical contact with the corresponding pad on the circuit board.

20. The housing of claim 18, wherein each metallic wire-trap spring contact assembly provides a contact force of between about 100 grams and about 200 grams to a corresponding pad on the circuit board.

21. The housing of claim 18, wherein:

the input and output ends of the base each include a first aperture and a second aperture, wherein the first aperture has a shape that is substantially different from that of the second aperture; and the input and output connectors each include a first bottom tab and a second bottom tab, wherein the first and second bottom tabs are substantially different in shape and are configured for insertion in the first and second apertures in the base.

22. The housing of claim 18, wherein:

the left and right sides of the cover include indented portions adjacent to the channels;

the input and output ends of the cover each include a left aperture in the indented portion of the left side of the cover, a right aperture in the indented portion of the right side of the cover, and a top aperture in the top side of the cover; and the input and output connectors each include left, right, and top tabs adapted for insertion in the left, right, and top apertures in the cover.

23. A housing for a gas discharge lamp ballast, comprising:

a metallic base for mounting a circuit board thereon, the base including an input end, an output end opposite the input end, a left end adjacent to the input and output ends, and a right end opposite the left end and adjacent to the input and output ends, wherein:

(a) the left and right ends of the base each include coined edges having a thickness substantially less than that of the rest of the base; and (b) the input and output ends of the base each include a first aperture and a second aperture, wherein the first aperture has a shape that is substantially different from that of the second aperture;

a cover having a top side, a left side at approximately right angles with the top side, and a right side at approximately right angles with the top side and remote from the left side, the left and right sides each including a channel for mating with the left and right ends of the base, wherein the left, right, and top sides of the cover are at least partially flexible so as to facilitate attachment of the cover to the coined edges of the left and right ends of the base, the cover having an input end and an output end, wherein the input end and the output end each include a left aperture in the left side of the cover, a right aperture in the right side of the cover, and a top aperture in the top side of the cover;

an input connector adapted to serve as a first end-cap of the housing, the input connector including a plurality of receptacles for receiving input wires and a plurality of tabs for mating with the corresponding apertures in the input ends of the base and cover;

an output connector adapted to serve as a second end-cap of the housing, the output connector including a plurality of receptacles for receiving output wires and a plurality of tabs for mating with the corresponding apertures in the output ends of the base and cover; and wherein the input and output connectors each further comprise:

(a) an insulating structure including a plurality of cavities defined therein, each cavity being adapted to receive a stripped end of a wire; and (b) a plurality of metallic wire-trap spring contact assemblies, each located within a corresponding cavity in the insulating structure, wherein each metallic wire-trap spring contact assembly includes:

(i) a wire-trap portion operable to deflect upon insertion of a stripped end of a wire into a corresponding receptacle in the insulating structure of the connector, thereby forming a channel for receiving and substantially securely retaining the stripped end of the wire; and (ii) a solderless connector portion coupled to the wire-trap portion and operable, upon attachment of the connector to the base, to deflect under contact with a corresponding pad on the circuit board and thereby provide a substantially secure electrical contact with the corresponding pad on the circuit board;

(c) a first bottom tab and a second bottom tab, wherein the first and second bottom tabs are substantially different in shape and are configured for insertion in the first and second apertures in the base; and (d) left, right, and top tabs adapted for insertion in the left, right, and top apertures in the cover.

* * * * *